US005979376A

United States Patent [19]

Hatano et al.

[11] Patent Number: 5,979,376

[45] **Date of Patent: *Nov. 9, 1999**

[54] VALVE OPERATING SYSTEM IN INTERNAL COMBUSTION ENGINE

[75] Inventors: Harumi Hatano; Toshihiro Yamaki; Chihaya Sugimoto; Shoichi Ogawa; Toshio Yokoyama, all of Saitama, Japan

[73] Assignee: Honda Giken Kogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/895,644

[22] Filed: Jul. 17, 1997

[30] Foreign Application Priority Data

Jul. 24, 1996 [JP] Japan ..... 8-194201

[51] Int. Cl.[6] ..... F01L 9/04; F16K 31/06

[52] U.S. Cl. ..... 123/90.11; 251/129.01; 251/192.16

[58] Field of Search ..... 123/90.11; 251/129.01, 251/129.02, 129.05, 129.1, 129.15, 129.16

[56] References Cited

U.S. PATENT DOCUMENTS 4,719,882 1/1988 Krueter ..... 123/90
4,883,025 11/1989 Richeson, Jr. ..... 123/90.11
5,548,263 8/1996 Bulgatz et al. ..... 123/90.11

FOREIGN PATENT DOCUMENTS 0 471 614 A1 2/1992 European Pat. Off. .
2192242 2/1974 France .
WO 95/00959 1/1995 WIPO .

*Primary Examiner*—Weilun Lo
*Attorney, Agent, or Firm*—Lyon & Lyon LLP

[57] ABSTRACT

A valve operating system in an internal combustion engine, that can be readily assembled and installed on the engine, including a casing coupled to an upper surface of a cylinder head, an armature, a pair of electromagnets for exerting electromagnetic forces on the armature in directions of opening and closing of an engine valve, and a pair of resilient means for biasing the engine valve in the opening and closing directions, respectively, and for retaining the armature at a predetermined neutral position by cooperation with each other during deenergization of both the electromagnets. The resilient means for closing the engine valve is mounted between a retainer fixed to the valve stem and a fixed position on the cylinder head, and the electromagnets are fixed within the casing which is constructed so that an upper portion of the stem can be inserted into the casing. Accommodated within the casing are the armature separatably coaxially connected at an upper end of the stem, and the resilient means for opening the engine valve and also exhibiting a resilient force for urging the armature against the first electromagnet to support the armature, when the armature is not connected to the stem.

11 Claims, 4 Drawing Sheets

VALVE OPERATING SYSTEM IN INTERNAL COMBUSTION ENGINE

The present invention relates to a valve operating system in an internal combustion engine, and particularly, to a valve operating system in an internal combustion engine including a casing coupled to an upper surface of a cylinder head, an armature operatively connected to a stem of an engine valve, a pair of electromagnets for applying an electromagnetic force to the armature in directions of opening and closing of the engine valve, and a pair of resilient means for biasing the engine valve in the opening and closing directions respectively and for retaining the armature at a predetermined neutral position by cooperation with each other during deenergization of both the electromagnets.

BACKGROUND OF THE INVENTION

Such a valve operating system is conventionally known, for example, from PCT International Patent Application Laid-open No. WO95/00959 and the like. In the valve operating system disclosed in that Patent Application, the armature is fixed to the upper end of the stem of the engine valve. In assembling the valve operating system to the cylinder head, the components disposed within the casing are assembled in sequence from the side of the cylinder head and finally, the casing is assembled to the cylinder head to cover these components. This assembling operation is carried out in a narrow space, and therefore the assemblability is poor.

SUMMARY OF THE INVENTION

The present invention has been accomplished with such circumstance in view, and it is an object of the present invention to provide a valve operating system in an internal combustion engine, wherein the assemblability of components is excellent.

To achieve the above object, there is provided a valve operating system in an internal combustion engine, comprising a casing separatably coupled to an upper surface of a cylinder head, an armature movably accommodated within said casing and operatively connected to a stem of an engine valve, a first electromagnet disposed within the casing at a location in which it is opposed to said armature to exhibit an electromagnetic force for attracting the armature to open the engine valve, a second electromagnet disposed within the casing at a location in which it is opposed to the armature to exhibit an electromagnetic force for attracting the armature to close the engine valve, a first resilient means for exhibiting a resilient force for biasing the engine valve in an opening direction, and a second resilient means for exhibiting a resilient force for biasing the engine valve in a closing direction and for retaining the armature at a predetermined neutral position by cooperation with the first resilient means during deenergization of the first and second electromagnets, wherein the second resilient means is mounted between a retainer fixed to the stem and a fixed position on the cylinder head; the first and second electromagnets are fixed within the casing constructed so that the upper portion of the stem can be inserted from below into the casing; and the following two members are accommodated within the casing: (a) the armature to which the upper end of the stem is separatably coaxially connected, and (b) the first resilient means for exhibiting the resilient force for urging the armature against the first electromagnet to support the armature, when the armature is not connected to the stem.

With such construction, the stem and the armature can be separated from each other, and both the electromagnets, the armature and the first resilient means can be accommodated and disposed within the casing to form a unit. In a condition in which the engine valve and the second resilient means have been assembled to the cylinder head, the unit is assembled to the cylinder head, thereby connecting the stem to the armature, thus completing the assembling of the valve operating system to the cylinder head.

Further, according to the present invention, the first and second electromagnets are accommodated within the casing, so that their movements in directions away from each other are limited by opposite ends of the casing, and the valve operating system further includes a sleeve interposed between the two electromagnets to surround the armature. Thus, it is possible to appropriately set the distance between the electromagnets.

Still further, according to the present invention, a guide shaft extending on the opposite side from the stem of the engine valve is fixed at its one end to the armature and slidably fitted in a guide member which is supported at an upper end of the casing. Thus, the movement of the armature, separatably connected to the stem, can be supported by the guide member, thereby avoiding, to the utmost, the exertion of vibration between the upper end of the stem and the armature during opening or closing of the engine valve to stabilize the behavior of the armature.

Furthermore, according to the present invention, the guide member is supported at the upper end of the casing for movement in an axial direction of the stem; the casing is provided with a limiting means for adjustably limiting the extent of axially outward movement of the guide member, and the first resilient means is mounted between the guide shaft and the guide member. Thus, it is possible to freely adjust the axial position of the guide member to regulate the resilient forces of the first and second resilient means.

Moreover, according to the present invention, a support tube is mounted at the lower end of the casing and is capable of being advanced and retreated in a direction coaxial with the stem, and a fixing means is also mounted at the lower end of the casing for fixing the support tube to the casing, so that the advanced or retreated position of the support tube can be regulated; and the first and second electromagnets with the sleeve interposed therebetween to surround the armature are clamped between the upper end of the casing and the upper end of the support tube. Thus, it is possible to firmly fix the electromagnets within the casing, while regulating the neutral position of the armature and the distance between the armature located at the neutral position and the electromagnets.

Still further, according to the present invention, the casing has support portions integrally provided thereon at an outer peripheral of the casing at a plurality of points spaced circumferentially of the stem, the support portions being fastened to the upper surface of the cylinder head. Thus, in assembling, to the cylinder head, the unit including the casing as well as the electromagnets, the armature and the first resilient means accommodated within the casing, the axial center of the stem and the axial centers of the electromagnets and the armature can be reliably matched with one another.

BRIEF DESCRIPTION OF THE DRAWINGS

The present invention will now be described by way of an embodiment with reference to the accompanying drawings, wherein.

DESCRIPTION OF A PREFERRED EMBODIMENT

Figure 1:
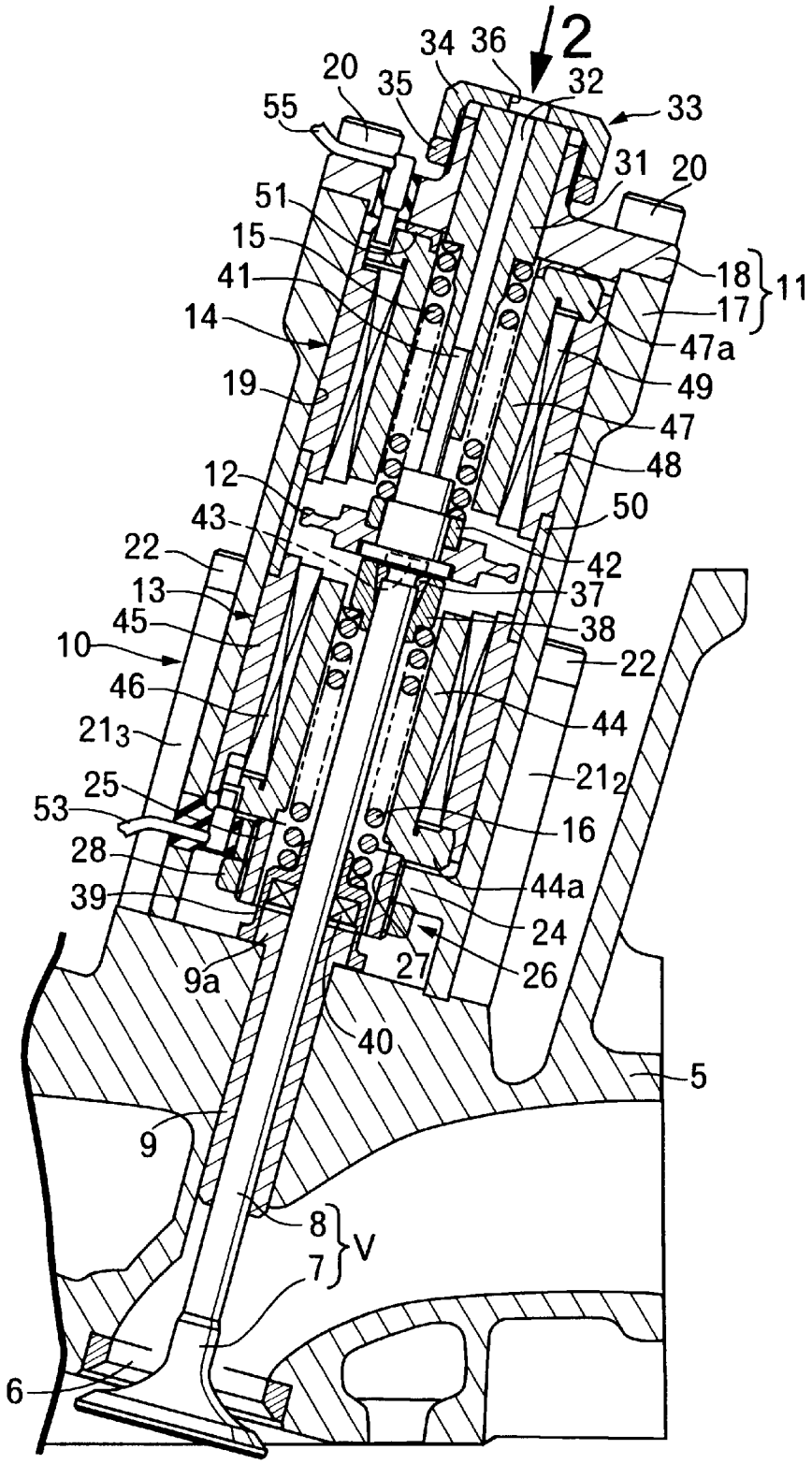
FIG. 1 is a vertical sectional view of a valve operating system, which is a sectional view taken along a line 1—1 in FIG. 2.

Referring first to FIG. 1, a pair of engine valves V, which are intake or exhaust valves, are disposed for each of the cylinders in a cylinder head 5 of an internal combustion engine. The engine valve V is comprised of a valve member 7 capable of opening and closing a valve bore 6 provided in the cylinder head 5, and a stem 8 integrally connected to the valve member 7 and slidably fitted into a guide tube 9. The guide tube 9 has, at its upper end, a flange portion 9*a* protruding radially outwards, and is fixed to the cylinder head 5 by press-fitting the flange portion 9*a* into the cylinder head 5 until it is engaged with an upper surface of the cylinder head 5.

A valve operating system 10 according to the present invention is disposed on the cylinder head 5 and connected to upper end of the stem 8 of each of the engine valves V. Each of the valve operating systems 10 is the same and therefore only one will be described.

The valve operating system 10 includes a casing 11 separatably coupled to the cylinder head 5, an armature 12 movably accommodated in the casing 11 and operatively connected to the stem 8 of the engine valve V, a first electromagnet 13 disposed within the casing 11 at a location in which it is opposed to a lower surface of the armature 12 to exhibit a electromagnetic force for attracting the armature 12 to open the engine valve V, a second electromagnet 14 disposed within the casing 11 at a location in which it is opposed to the upper surface of the armature 12 to exhibit an electromagnetic force for attracting the armature 12 to close the engine valves V, a first coil spring 15 as a first resilient means for exhibiting a resilient force for biasing the engine valves V in an opening direction, and a second coil spring 16 as a second resilient means for exhibiting a resilient force for biasing the engine valves V in a closing direction and for retaining the armature 12 at a predetermined neutral portion by cooperation with the first coil spring 15 during deenergization of the first and second electromagnets 13 and 14.

Figure 2:
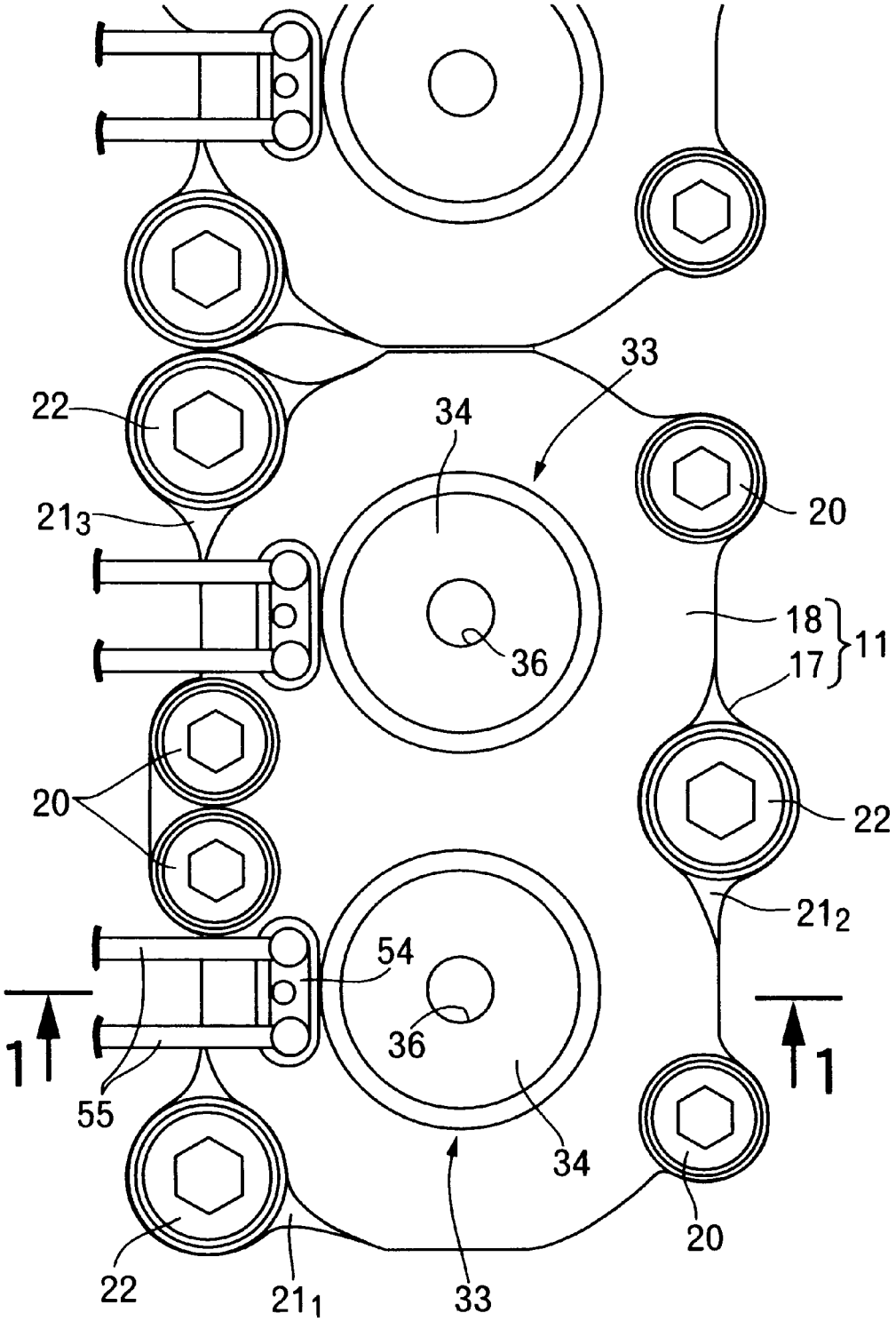
FIG. 2 is a plan view taken in the direction of arrow 2 in FIG. 1.

Referring also to FIG. 2, the casing 11 is fastened to the upper surface of the cylinder head 5 and is common to the pair of engine valves V. The casing 11 is comprised of a casing body 17 and lid plate 18 fixed to an upper surface of the casing body 17. The casing body 17 is provided with an accommodating bore 19 which extends coaxially with each stem 8 in individual correspondence to each of the engine valves V. The lid plate 18 is fastened to the upper surface of the casing body 17 by a plurality of, e.g., four bolts 20, so that it closes the upper ends of both the accommodating bores 19.

Three vertically extending support portions $\mathbf{21}_1$, $\mathbf{21}_2$ and $\mathbf{21}_3$ are integrally provided at a lower portion of an outer periphery of the casing body 17. The support portions $\mathbf{21}_1$ and $\mathbf{21}_2$ are disposed at two circumferentially spaced points relative to the stem 8 of one of the engine valves V, and the support portions $\mathbf{21}_2$ and $\mathbf{21}_3$ are disposed at two circumferentially spaced points relative to the stem 8 of the other engine valve V. Fastening bolts 22 are inserted through the support portions $\mathbf{21}_1$ to $\mathbf{21}_3$, and the casing 11 is fastened to the upper surface of the cylinder head 5 by threaded insertion of the fastening bolts 22 into the cylinder head 5.

Figure 3:
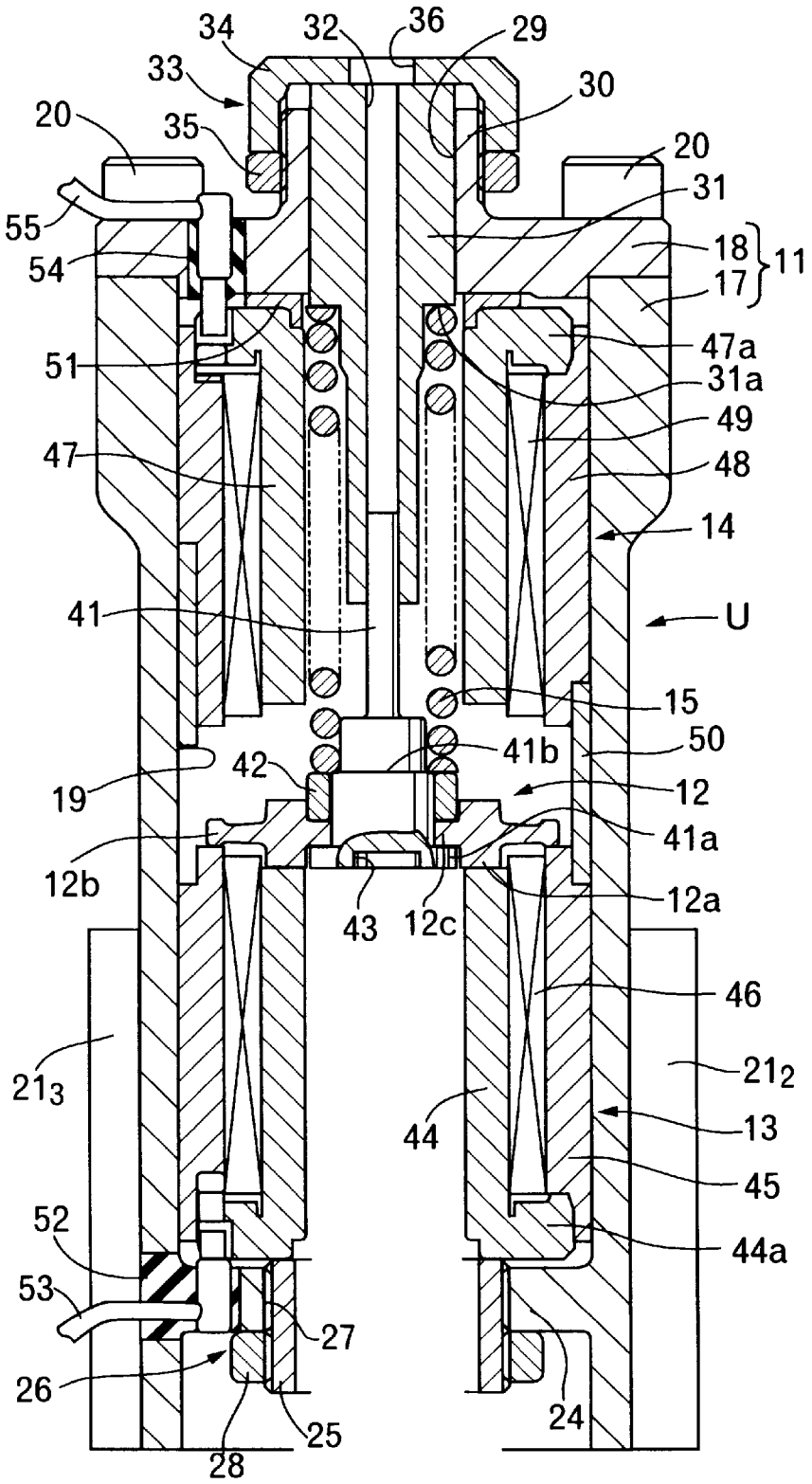
FIG. 3 is an enlarged view of an essential portion shown in FIG. 1.

Referring also to FIG. 3, a support collar 24 is integrally provided at a lower end of the casing 11, i.e., at a lower end of the casing body 17 and protrudes radially inwards from an inner surface of the accommodating bore 19. Threadedly mounted on the support collar 24 is a support tube 25 capable of being advanced and retreated coaxially with the stem 8 of the engine valve V, and a fixing means 26 is threadedly mounted on the support tube 25 for fixing the support tube 25 to the support collar 24, so that the advanced or retreated position of the support tube 25 can be adjusted.

The support tube 25 is threadedly engaged with internal threads 27 provided on an inner periphery of the support collar 24 and can be advanced and retreated in a direction coaxial with the stem 8 by turning thereof. The fixing means 26 is formed into a double-nut structure by a structure of threaded engagement with the internal threads 27 of the support tube 25 and by a retaining nut 28 which is threadedly fitted over the support tube 25 and engaged with a lower surface of the support collar 24. Thus, the fixing means 26 is capable of firmly fixing the support tube 25 to the lower end of the support collar 24, i.e., the casing 11, so that the support tube 25 can be advanced and retreated in the direction coaxial with the stem 8.

On the other hand, a cylindrical portion 30 is integrally provided at the upper end of the casing 11, i.e., on the lid plate 18 to protrude upwards and defines a support bore 29 coaxial with the stem 8. An upper portion of a cylindrical guide member 31 is slidably received in the support bore 29 for movement along an axis of the stem 8. A slide bore 32 is provided in the guide member 31 over the entire vertical length of the guide member 31.

A limiting means 33 is mounted on the cylindrical portion 30, so that the extent of the axial outward movement of the guide member 31 can be adjusted. The limiting means 33 is formed into a double-nut structure by (1) a cap nut 34 which is threadedly fitted over the cylindrical portion 30, so that the upper end of the guide member 31 abuts against the closed end of the cap nut 34, and (2) a retaining nut 35 which is threadedly fitted over the cylindrical portion 30 to limit the advanced or retreated position of the cap nut 34. Thus, the extent or position of the axially outward movement of the guide member 31 can be regulatably firmly limited. An open bore 36 is provided in the closed end of the cap nut 34 and coaxially communicates with the slide bore 32 in the guide member 31.

The upper portion of the stem 8 of the engine valve V is inserted from below into the casing body 17, so that it is coaxially passed through the support tube 25. A retainer 38 is fixed to the upper end of the stem 8 by a split cotter 37. A cap-like receiving member 39 abuts against the upper end of the cylinder head 5 to cover the flange portion 9*a* of the guide tube 9. The second coil spring 16 is mounted between the retainer 38 and the receiving member 39 to surround the stem 8 which is axially and slidably passed through the receiving member 39, so that the stem 8, i.e., the engine valve V is resiliently biased in the closing direction by the spring force of the second coil spring 16. Moreover, a ring-like seal member 40 slidable on the outer surface of the stem 8 is retained within the receiving member 39.

The armature 12 is formed into a disk-like shape and has a cylindrical portion 12*a*, a collar portion 12*b* protruding radially outward from an axial middle of the cylindrical portion 12*a*, and a limiting collar 12*c* protruding radially inward from the axial middle of the cylindrical portion 12*a*.

A guide shaft 41 extending coaxially with the stem 8 of the engine valve V on the opposite side from the stem 8 is fixed at one end thereof to the armature 12. More specifically, an engage collar portion 41*a* is provided at one end, i.e., a lower end of the guide shaft 41 to engage a lower surface of the limiting collar portion 12*c* of the armature 12, and a ring 42 fitted over and fixed to a lower portion of the guide shaft 41 by press-fitting or the like is engaged with an upper surface of the limiting collar portion 12*c*. Thus, the limiting collar portion 12*c* of the armature 12 is clamped by the engage collar portion 41*a* and the ring 42, whereby one end of the guide shaft 41 is fixed to the armature 12.

The upper portion of the guide shaft 41 is slidably fitted into the slide bore 32 in the guide member 31. The first coil spring 15 surrounding the guide member 31 and the guide shaft 41 is mounted between a stepped portion 31*a* provided at the upper portion of the guide member 31 to face the armature 12, a stepped portion 41*b* provided at the lower portion of the guide shaft 41 to face the opposite side from the armature, and the ring 42, so that the armature 12 is resiliently biased downwards, i.e., in the opening direction of the engine valve V by the spring force of the first coil spring 15.

The upper end of the stem 8 of the engine valve V is separatably coaxially connected to the armature 12, and a recess 43 for insertion and contacting of the upper end of the stem 8 is provided in a lower end face of the guide shaft 41 that is coaxially fixed to the armature 12.

The first electromagnet 13 is fixedly disposed at a lower portion of the accommodating bore 19, so that it is opposed to the lower surface of the armature 12. The first electromagnet 13 is comprised of a cylindrical inner yoke 44 coaxially surrounding the stem 8 and the second coil spring 16, a cylindrical outer yoke 45 fitted in the accommodating bore 19 to coaxially surround the inner yoke 44, and a ring-like coil assembly 46 interposed between the inner and outer yokes 44 and 45 and having a coil wound around a bobbin made of a synthetic resin. A radially outward protruding flange portion 44*a* is integrally provided at a lower end of the inner yoke 44 and has an outer edge engaged with a lower end of the outer yoke 45.

The second electromagnet 14 is fixedly disposed at an upper portion of the accommodating bore 19, so that it is opposed to the upper surface of the armature 12. The second electromagnet 14 is comprised of a cylindrical inner yoke 47 coaxially surrounding the guide shaft 41 and the guide member 31, a cylindrical outer yoke 48 fitted in the accommodating bore 19 to coaxially surround the inner yoke 47, and a ring-like coil assembly 49 interposed between the inner and outer yokes 47 and 48 and having a coil wound around a bobbin made of a synthetic resin. A radially outward protruding flange portion 47*a* is integrally provided at an upper end of the inner yoke 47 and has an outer edge engaged with an upper end of the outer yoke 48.

A sleeve 50 is fitted into the accommodating bore 19 in a ring-like configuration to surround the armature 12 and is interposed between the outer yoke 45 of the first electromagnet 13 and the outer yoke 48 of the second electromagnet 14. The lower end of the inner yoke 44 of the first electromagnet 13 is supported in an abutting manner on the upper end of the support tube 25. A shim 51 is interposed between the upper end of the inner yoke 47 of the second electromagnet 14 and the lid plate 18 of the casing 11. More specifically, the first and second electromagnets 13 and 14 with the sleeve 50 interposed therebetween are fixed within the casing by clamping between the shim 51 disposed at the upper end of the casing 11 and the upper end of the support tube 25.

A grommet 52 is fitted in the lower end portion of the casing body 17 which corresponds to the support collar 24. A pair of lead wires 53 connected to the coil of the coil assembly 46 of the first electromagnet 13 are passed through the grommet 52 and drawn outside the casing 11. A grommet 54 is fitted in the lid plate 18, and a pair of lead wires 55 connected to the coil of the coil assembly 49 of the second electromagnet 14 are passed through the grommet 54 and drawn outside the casing 11.

The operation of the embodiment will be described below. The upper portion of the stem 8 of the engine valve V is capable of being inserted from below into the casing 11 coaxially through the support tube 25 at the lower end of the casing 11. The first and second electromagnets 13 and 14 are fixed within the casing 11, and the armature 12, to which the upper end of the stem 8 is separatably coaxially connected, is accommodated in the casing 11. The first coil spring 15 for biasing the engine valve V in the opening direction is mounted between the guide shaft 41 fixed to the armature 12 and the guide member 31 supported at the upper end of the casing 11, and is accommodated in the casing 11. On the other hand, the retainer 38 is fixed to the upper end of the stem 8, and the second coil spring 16 is mounted between the receiving member 39 located at a fixed position on the upper surface of the cylinder head 5 and the retainer 38.

Figure 4:
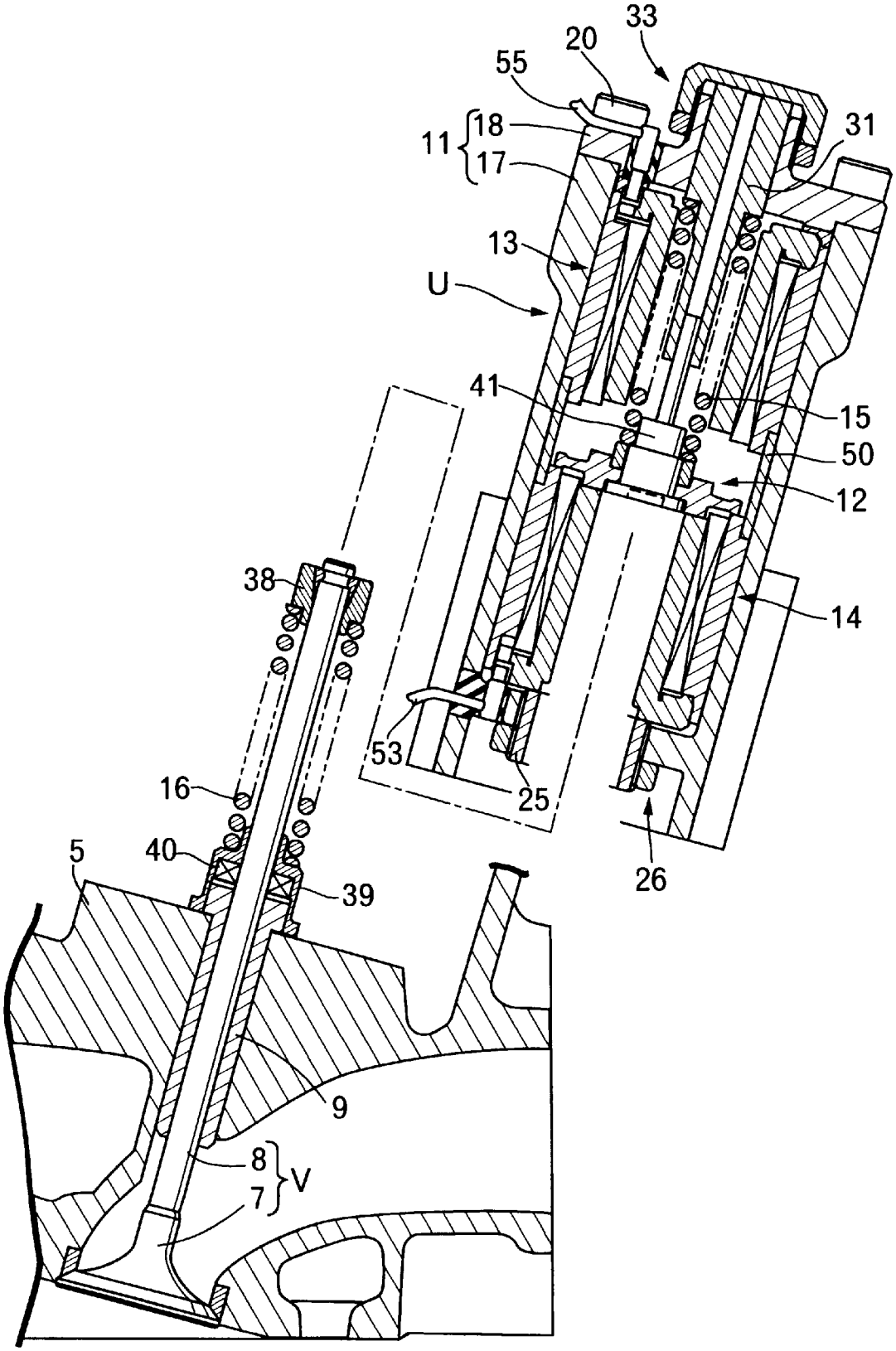
FIG. 4 is an exploded vertical sectional view of the valve operating system shown during assembling.

Therefore, as shown in FIGS. 3 and 4, the first and second electromagnets 13 and 14, the armature 12, the guide shaft 41 fixed to the armature 12 and the like can be accommodated and disposed within the casing 11 to form a pre-assembled unit U. Thus, the pre-assembled unit U can be prepared by a previous assembling conducted away from the narrow space above the cylinder head 5. In this pre-assembled unit U, the armature 12 is urged against the first electromagnet 13 by the first coil spring 15 and supported by the first electromagnet 13.

In assembling the valve operating system 10 to the cylinder head 5, the pre-assembled unit U need only be assembled to the cylinder head 5 in a condition in which the engine valves V, the second coil spring 16 and the like have been assembled to the cylinder head 5, as shown in FIG. 4. The upper end of the stem 8 inserted from below into the casing 11 is inserted into the recess 43 in the lower end face of the guide shaft 41 to abut against the bottom of the recess 43, and the armature 12 is coaxially connected to the stem 8 and pushed upwards away from the first electromagnet 13 by installing the three bolts 22. This completes the assembling of the valve operating system 10 and completes the attachment of the valve-operating system 10 to the cylinder head 5. Thus, it is possible to enhance the assemblability of the valve operating system 10.

Moreover, the support tube 25, which is capable of being advanced and retreated in the direction coaxial relative to the stem 8, is mounted at the lower end of the casing 11 and the fixing means 26 is also mounted at the lower end of the casing 11 for fixing the support tube 25 to the casing 11, so that the advanced or retreated position of the support tube 25 can be adjusted before installing the unit U on the cylinder head 5. The first and second electromagnets 13 and 14 with the sleeve 50 interposed therebetween are clamped between the shim 51 at the upper end of the casing 11 and the upper end of the support tube 25. Therefore, the electromagnets 13 and 14 in the pre-assembled unit U can be firmly fixed within the casing 11, while regulating the neutral position of the armature 12 determined by the first and second coil springs 15 and 16 as well as the distance between the armature 12 located at the neutral position and the electromagnets 13 and 14.

The guide member 31 is supported at the upper end of the casing 11 for movement in the axial direction of the stem 8, and the limiting means 33 for regulatably limiting the position of axially outward movement of the guide member 31 is mounted on the casing 11. The first coil spring 15 is mounted between the guide shaft 41 fixed to the armature 12 and the guide member 31. Therefore, the axial position of the guide member 31 can be freely adjusted to regulate the spring force of the first coil spring 15 and further to adjust the spring force of the second coil spring 16 in accordance with a variation in spring force of the first coil spring 15.

Further, the support portions $\mathbf{21}_1$ to $\mathbf{21}_3$ are integrally provided on the outer periphery of the casing 11 at the plurality of points spaced circumferentially of each stem 8 and are fastened to the upper surface of the cylinder head 5 by the fastening bolts 22. Therefore, the axial centers of the first and second electromagnets 13 and 14 and the armature 12 accommodated in the pre-assembled unit U can be reliably matched with the axial center of the stem 8 of the engine valve V.

The guide shaft 41 fixed to the armature 12 and the upper end of the stem 8 of the engine valve V are merely in contact with each other, and the guide shaft 41 is slidably fitted in the guide member 31 supported at the upper end of the casing 11. Therefore, the movement of the armature 12, separatable from the stem 8, can be supported by the guide member 31 to avoid, to the utmost, the exertion of vibration between the upper end of the stem 8 and the armature 12 during opening or closing of the engine valve V, thereby stabilizing the behavior of the armature 12.

The electromagnets 13 and 14 are firmly fixed within the casing 11, as described above and hence, cannot be finely vibrated with opening or closing of the engine valve V, thereby enabling the opening and closing of the engine valve V to be stabilized.

Although the embodiment of the present invention has been described in detail, it will be understood that the present invention is not limited to the above-described embodiment, and various modifications in design may be made without departing from the spirit and scope of the invention defined in claims.

As discussed above, according to the present invention, the valve stem and the armature can be separated from each other, and both the electromagnets, the armature and the first resilient means can be accommodated and disposed within the casing to form the unit. In the condition in which the engine valve and the second resilient means have been assembled to the cylinder head, the unit can be assembled to the cylinder head, thereby connecting the stem to the armature, thus simultaneously completing the assembling of the valve operating system and the attachment of the valve operating system to the cylinder head.

Further, according to the present invention, the distance between the first and second electromagnets can be appropriately set by the fact that the sleeve is interposed between both the first and second electromagnets.

Still further according to the present invention, the movement of the armature separatably connected to the stem can be supported by the guide member to avoid, to the utmost, the exertion of vibration between the upper end of the stem and the armature during opening or closing of the engine valve to stabilize the behavior of the armature.

Moreover, according to the present invention, it is possible to regulate and limit the extent of axially outward movement of the guide member supported at the upper end of the casing by the limiting means, thereby freely regulating the axial position of the guide member to adjust the resilient forces of the first and second resilient means.

Furthermore, according to the present invention, it is possible to firmly fix the first and second electromagnets with the sleeve interposed therebetween within the casing in such a manner that the first and second electromagnets are clamped between the upper end of the casing and the upper end of the support tube, while regulating the neutral position of the armature and the distance between the armature in the neutral position and the electromagnets.

Further, according to the present invention, in assembling, to the cylinder head, the unit including the casing as well as the electromagnets, the armature and the first resilient means accommodated within the casing, the axial center of the valve stem can be reliably matched with the axial centers of the electromagnets and the armature.

What is claimed is:

1. A valve operating system in an internal combustion engine, comprising a casing separatably coupled to an upper surface of a cylinder head, an armature movably accommodated within said casing and operatively connected to a stem of an engine valve, a first electromagnet disposed within the casing at a location in which it is opposed to said armature to exhibit an electromagnetic force for attracting said armature to open the engine valve, a second electromagnet disposed within the casing at a location in which it is opposed to said armature to exhibit an electromagnetic force for attracting said armature to close the engine valve, a first resilient means for exhibiting a resilient force for biasing said engine valve in an opening direction, a second resilient means for exhibiting a resilient force for biasing said engine valve in a closing direction and for retaining the armature at a predetermined neutral position by cooperation with the first resilient means during deenergization of the first and second electromagnets, said second resilient means being mounted between a retainer fixed to the stem and a fixed position on the cylinder head, said first and second electromagnets being fixed within said casing and constructed so that the upper portion of said stem can be inserted from below into the casing, said armature to which the upper end of said stem is separatably coaxially connected being accommodated within said casing, said first resilient means for exhibiting the resilient force for urging the armature against said first electromagnet to support said armature, when said armature is not connected to said stems, being accommodated within said casing, a support tube mounted at the lower end of said casing and capable of being advanced and retreated in a direction coaxial with said stem, and a fixing means also mounted at the lower end of said casing for fixing said support tube to said casing, so that the advanced or retreated position of the support tube can be adjusted, and wherein said first and second electromagnets with a sleeve interposed therebetween to surround the armature are clamped between the upper end of said casing and an upper end of said support tube.

2. A valve operating system in an internal combustion engine according to claim 1, wherein said first and second electromagnets are accommodated within said casing, so that their movements in directions away from each other are limited by opposite ends of said casing, and said valve operating system further includes a sleeve interposed between the electromagnets to surround said armature.

3. A valve operating system in an internal combustion engine according to claim 1, further including a guide shaft which extends on the opposite side from the stem of said engine valve and which is fixed at its one end to said armature, said guide shaft being slidably fitted in a guide member which is supported at an upper end of said casing.

4. A valve operating system in an internal combustion engine according to claim 3, wherein said guide member is supported at the upper end of said casing for movement in an axial direction of the stem, and said casing is provided with a limiting means for adjustably limiting a position of axially outward movement of said guide member, said first resilient means being mounted between the guide shaft and said guide member.

5. A valve operating system in an internal combustion engine according to claim 1, wherein said casing has support portions integrally provided thereon at an outer periphery of the casing at a plurality of points spaced circumferentially of said stem, said support portions being fastened to the upper surface of said cylinder head.

6. A valve operating system in an internal combustion engine, the valve operating system having an armature operatively connected to a stem of an engine valve, a first electromagnetic disposed at a location in which it is opposed to said armature to exhibit an electromagnetic force for attracting said armature to open the engine valve, a second electromagnet disposed at a location in which it is opposed to said armature to exhibit an electromagnetic force for attracting said armature to close the engine valve, a first resilient means for exhibiting a resilient force for biasing said engine valve in an opening direction, and a second resilient means for exhibiting a resilient force for biasing said engine valve in a closing direction and for retaining the armature at a predetermined neutral position by cooperation with the first resilient means during deenergization of the first and second electromagnets, an improvement comprising;

a casing having means for supporting said first and second electromagnets in a fixed position within said casing including a support tube mounted at the lower end of said casing and capable of being advanced and retreated in an axial direction, and a fixing means also mounted at the lower end of said casing for fixing said support tube to said casing so that the advanced or retreated position of the support tube can be adjusted, said first and second electromagnets with a sleeve interposed therebetween being clamped between the upper end of said casing and an upper end of said support tube, said casing having means for supporting said first resilient means in said casing and adjusting the resilient force applied to said armature, and said casing constructed and arranged for supporting said first and second electromagnets, said armature and said first resilient means in said casing as a preassembled unit and permitting said preassembled unit to be installed over said stem and second resilient means separately installed on a cylinder head of the engine with said stem operatively engaging said armature when said preassembled unit is installed on the cylinder head.

7. A valve operating system according to claim 6, wherein said casing has support portions integrally provided thereon at a plurality of points diametrically spaced relative to said stem, and fasteners for fastening said support portions to the cylinder head.

8. A valve operating system according to claim 7, wherein said first resilient means urges the armature against said first electromagnet to support said armature in the preassembled unit.

9. A valve operating system according to claim 7, wherein said first and second electromagnets are supported within said casing so that movements in directions away from each other are limited by opposite ends of said casing.

10. A valve operating system according to claim 7, said preassembled unit further includes a guide shaft supported in said casing and fixed at one end to said armature, and said guide shaft being slidably fitted in a guide member which is supported at an upper end of said casing.

11. A valve operating system according to claim 10, wherein said guide member is adjustably supported at the upper end of said casing for movement in an axial direction of the stem, and said casing is provided with a limiting means for adjustably limiting the axial outward position of said guide member, said first resilient means being mounted between the guide shaft and said guide member.

* * * * *